US006106986A

United States Patent [19]

Shirai et al.

[11] Patent Number: 6,106,986

[45] Date of Patent: Aug. 22, 2000

[54] COLOR TONER

[75] Inventors: Eiji Shirai; Shinichi Sata; Toshihiro Hattori; Hironobu Nagasaki; Yoshifumi Tokuhisa, all of Wakayama, Japan

[73] Assignee: Kao Corporation, Tokyo, Japan

[21] Appl. No.: 09/441,444

[22] Filed: Nov. 17, 1999

[30] Foreign Application Priority Data

Nov. 17, 1998 [JP] Japan ..... 10-327196

[51] Int. Cl.[7] ..... G03G 9/09; G03G 9/087; G03G 9/097

[52] U.S. Cl. ..... 430/106; 430/110; 430/111; 430/903

[58] Field of Search ..... 430/106, 110, 430/111, 903

[56] References Cited

U.S. PATENT DOCUMENTS

| | | | |
|---|---|---|---|
| 5,800,959 | 9/1998 | Ikami | 430/111 |
| 5,843,605 | 12/1998 | Anno et al. | 430/106 |
| 5,853,938 | 12/1998 | Nakazawa et al. | 430/110 |
| 5,935,751 | 12/1998 | Matsuoka et al. | 430/111 |
| 5,958,641 | 9/1999 | Sano et al. | 430/110 |
| 5,998,074 | 12/1999 | Miyamoto et al. | 430/106 |

FOREIGN PATENT DOCUMENTS

| | | |
|---|---|---|
| 5341577 | 12/1993 | Japan . |
| 6161153 | 6/1994 | Japan . |
| 6289645 | 10/1994 | Japan . |
| 8220808 | 8/1996 | Japan . |

*Primary Examiner*—Roland Martin
*Attorney, Agent, or Firm*—Birch, Stewart, Kolasch & Birch, LLP

[57] ABSTRACT

A color toner comprising (A) a resin binder comprising a polyester, as a main component, obtained by polycondensing a polyhydric alcohol component and a carboxylic acid component, wherein the polyhydric alcohol component comprises a compound represented by the formula (I):

(I)

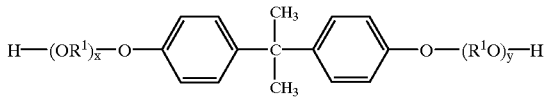

wherein $R^1$ is an alkylene group having 2 to 4 carbon atoms; x and y are positive numbers, wherein a sum of x and y is from 1 to 16, in an amount of 5% by mol or more of an entire polyhydric alcohol component, and wherein the carboxylic acid component comprises 50% by mol or more of a dicarboxylic acid compound and 50% by mol or less of a tricarboxylic or higher polycarboxylic acid compound; (B) a releasing agent having an average diameter size of dispersed particles in the color toner of from 0.1 to 3 μm; (C) a coloring agent; and (D) an external additive having a particle size of from 4 to 200 nm, wherein the content of the external additive is 1 to 5 parts by weight, based on 100 parts by weight of the toner before treatment with the external additive, wherein the color toner has a glass transition point of from 56° to 75° C., and a water content of from 0.1 to 0.5% by weight.

12 Claims, No Drawings

COLOR TONER

BACKGROUND OF THE INVENTION

1. Field of the Invention

The present invention relates to a color toner used for development of electrostatic latent images which are formed in electrophotography, electrostatic recording methods, electrostatic printing methods, or the like, and a process for nonmagnetic one-component development by applying the color toner.

2. Discussion of the Related Art

Conventionally, heat roll fixing methods have been widely employed as a method for fixing visible images. However, when a color toner is applied to the heat roll fixing method, offset phenomenon is likely to take place, because the color toner contains compounds having low softening points in large amounts, from the viewpoint of light properties. Therefore, there has been proposed a toner containing a releasing agent such as carnauba wax, montan wax, candelilla wax, or rice wax (Japanese Patent Laid-Open Nos. Hei 5-341577 and Hei 8-220808). However, there arise such problems that the various condition settings are insufficient, so that there are defects in the filming resistance property onto the photoconductor, the offset resistance property, and the transparency of the fixed toner. Further, there have not been reported any toners satisfying all properties required for color toners such as storage ability, durability and color reproducibility.

An object of the present invention is to provide a color toner being free from filming onto a photoconductor and less likely to cause offset, and having excellent storage ability, durability and color reproducibility.

Another object of the present invention is to provide a process for nonmagnetic one-component development applying the color toner.

These objects and other objects of the present invention will be apparent from the following description.

SUMMARY OF THE INVENTION

In sum, the present invention pertains to a color toner comprising:

(A) a resin binder comprising a polyester, as a main component, obtained by polycondensing a polyhydric alcohol component and a carboxylic acid component, wherein the polyhydric alcohol component comprises a compound represented by the formula (I):

(I)

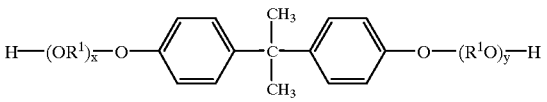

wherein $R^1$ is an alkylene group having 2 to 4 carbon atoms; x and y are positive numbers, wherein a sum of x and y is from 1 to 16, in an amount of 5% by mol or more of an entire polyhydric alcohol component, and wherein the carboxylic acid component comprises 50% by mol or more of a dicarboxylic acid compound and 50% by mol or less of a tricarboxylic or higher polycarboxylic acid compound;

(B) a releasing agent having an average diameter size of dispersed particles in the color toner of from 0.1 to 3 $\mu$m;

(C) a coloring agent; and (D) an external additive having a particle size of from 4 to 200 nm, wherein the content of the external additive is 1 to 5 parts by weight, based on 100 parts by weight of the toner before treatment with the external additive, wherein the color toner has a glass transition point of from 56° to 75° C., and a water content of from 0.1 to 0.5% by weight; and a process for nonmagnetic one-component development applying the color toner to an apparatus for nonmagnetic one-component development.

DETAILED DESCRIPTION OF THE INVENTION

The resin binder used for the toner of the present invention comprises a polyester as a main component. It is desired that the content of the polyester is from 50 to 100% by weight, preferably from 90 to 100% by weight, more preferably 100% by weight, in the resin binder, from the viewpoints of the dispersibility of the coloring agent and the fixing ability and the triboelectric properties of the resulting toner. The resins which can be used other than the polyester for the resin binder include polyamides, acrylic resins, epoxy resins, polycarbonates, polyurethanes, silicone resins, fluororesins, petroleum resins, natural and synthetic waxes, and the like.

The polyester is obtained by polycondensing a polyhydric alcohol component and a carboxylic acid component, wherein the polyhydric alcohol component comprises a compound represented by the formula (I):

(I)

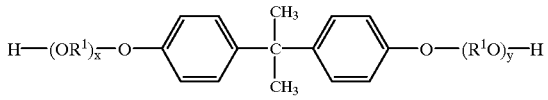

wherein $R^1$ is an alkylene group having 2 to 4 carbon atoms; x and y are positive numbers, wherein a sum of x and y is from 1 to 16; and wherein the carboxylic acid component comprises a dicarboxylic acid compound and a tricarboxylic or higher polycarboxylic acid compound.

In the present invention, the polyhydric alcohol component contains the compound represented by the formula (I) in an amount of 5% by mol or more, preferably 50% by mol or more, from the viewpoints of the dispersibility of the coloring agent and the fixing ability of the toner.

The compound represented by the formula (I) includes alkylene oxide (average additional molar number: 1 to 16) adducts of bisphenol A such as polyoxypropylene(2.2)-2,2-bis(4-hydroxyphenyl)propane and polyoxyethylene(2.2)-2,2-bis(4-hydroxyphenyl)propane. In addition, other polyhydric alcohol components include ethylene glycol, propylene glycol, glycerol, pentaerythritol, trimethylolpropane, hydrogenated bisphenol A, sorbitol, or alkylene oxide adducts thereof. These polyhydric alcohol components may be used alone or in admixture of two or more compounds.

In addition, from the viewpoints of the color reproducibility and the fixing ability of the toner, the carboxylic acid components contain a dicarboxylic acid compound in an amount of 50% by mol or more, preferably from 50 to 95% by mol, and the carboxylic acid components contain a tricarboxylic or higher polycarboxylic acid compound in an amount of 50% by mol or less, preferably from 5 to 50% by mol.

The dicarboxylic acid compound includes phthalic acid, isophthalic acid, terephthalic acid, fumaric acid, maleic acid, succinic acids substituted by an alkyl group having 1 to 20 carbon atoms or an alkenyl group having 2 to 20 carbon atoms such as dodecenylsuccinic acid and octylsuccinic acid, acid anhydrides thereof, alkyl esters thereof (alkyl moiety having 1 to 8 carbon atoms), and the like.

The tricarboxylic or higher polycarboxylic acid compound includes trimellitic acid, pyromellitic acid, acid anhydrides thereof, alkyl esters thereof (alkyl moiety having 1 to 8 carbon atoms), and the like.

The polycondensation of the polyhydric alcohol component with the carboxylic acid component can be carried out, for instance, by reacting the components at a temperature of from 180° to 250° C. in an inert gas atmosphere in the presence of an esterification catalyst, as needed.

The releasing agent used in the toner of the present invention includes natural waxes such as carnauba wax and rice wax; synthetic waxes such as low-molecular weight polypropylene, low-molecular weight polyethylene, and Sazole wax; coal waxes such as montan wax, and the like. Among these waxes, carnauba wax is preferable from the viewpoint of its compatibility with the polyester resin.

The melting point of the releasing agent is preferably from 65° to 110° C., more preferably from 70° to 100° C., from the viewpoints of the storage ability and the offset resistance of the resulting toner.

The content of the releasing agent is preferably from 1 to 10 parts by weight, more preferably from 1.5 to 5 parts by weight, based on 100 parts by weight of the resin binder, from the viewpoints of the offset resistance and the fixing ability of the resulting toner.

The releasing agent in the toner has endothermic energy preferably of from 5 to 25 mj per 1 mg of the toner, more preferably from 7 to 15 mj per 1 mg of the toner, from the viewpoint of the energy efficiency.

The releasing agent has an average diameter size of the dispersed particles in the color toner of the present invention of from 0.1 to 3 $\mu$m, preferably from 0.4 to 1.5 $\mu$m, more preferably from 0.6 to 1.2 $\mu$m, in order to obtain an excellent effect of preventing offset, prevent filming of the toner onto the photoconductor, and obtain stable fixed images.

The coloring agent used for the toner of the present invention may be any of dyes and pigments conventionally used for the coloring agent for full color development without particular limitation. From the aspect of color reproducibility, it is preferable to respectively use a yellow pigment including one or more yellow pigments selected from the group consisting of C.I. Pigment Yellow (hereinafter referred to as "P.Y.") 17, P.Y. 93, P.Y. 128, P.Y. 151, P.Y. 155, P.Y. 173, P.Y. 180, P.Y. 185, and Solvent Yellow (hereinafter referred to as "S.Y.") 162; a magenta pigment including one or more magenta pigments selected from the group consisting of C.I. Pigment Red (hereinafter referred to as "P.R.") 57:1, P.R. 122, and P.R. 184; and a cyan pigment including one or more cyan pigments selected from the group consisting of C.I. Pigment Blue (hereinafter referred to as "P.B.") 15:3, P.B. 15, P.B. 15:4, and C.I. Pigment Green (hereinafter referred to as "P.G.") 7. The amount of the coloring agent is preferably from 0.5 to 10 parts by weight, based on 100 parts by weight of the resin binder. The toner of the present invention can be used for toner for full color development by formulating these coloring agents.

In the present invention, in order to impart flowability to the toner and to even more effectively prevent filming onto the photoconductor, a relatively large amount of an external additive is used.

The external additive to be used for toner of the present invention includes silicon dioxide (silica), titanium dioxide (titania), aluminum oxide, zinc oxide, magnesium oxide, cerium oxide, iron oxide, copper oxide, tin oxide, and the like, among which a preference is given to silica from the aspect of imparting the triboelectric chargeability. Particularly in the present invention, a preference is given to hydrophobic silica in which a hydrophobic treatment agent such as hexamethyldisilazane or a silicone oil is adsorbed to the surface of silica particles.

Commercially available hydrophobic silica subjected to hydrophobic treatment includes "AEROSIL R-972" (manufactured by Nihon Aerosil K.K., average particle size: about 16 nm); "HDK H2000" (manufactured by Wacker Chemicals, average particle size: about 12 nm); "CAB-O-SIL TS-530" (manufactured by CABOT, average particle size: about 8 nm), and the like. These external additives may be used alone or in admixture of two or more kinds.

The particle size of the external additive is from 4 to 200 nm, preferably from 8 to 30 nm. The particle size of the external additive can be obtained from a photograph taken with a scanning electron microscope or transmission electron microscope.

The content of the external additive is from 1 to 5 parts by weight, preferably from 1.5 to 3.5 parts by weight, based on 100 parts by weight of the toner before treatment with the external additive. In a case where a hydrophobic silica is used as an external additive, however, a desired effect as described above is obtained by adding the hydrophobic silica in an amount of 1 to 3 parts by weight, based on 100 parts by weight of the toner before the treatment with an external additive.

The toner of the present invention is not particularly limited, and includes pulverized toners, polymerization toners, encapsulated toners, and the like. For example, the toner of the present invention can be prepared by adding an external additive to a powder obtained by a conventionally known method, such as a kneading-pulverization method, a spray-drying method or a polymerization method. For instance, a powder can be prepared by homogeneously mixing a resin binder, a coloring agent, a releasing agent, and the like with a mixer such as a Henschel mixer, thereafter melt-kneading the mixture with a kneader, an extruder, a continuous, twin roller type kneader, or the like, preferably a continuous, twin roller type kneader, and subsequently cooling, pulverizing and classifying the product. In the present invention, the conditions of the employed kneader are preferably selected such that in a case of a continuous, twin roller type kneader, the rotational speed of the high rotation roller is set to be 50 to 100 rotations per minute, and that of the low rotation roller is set to be less than that of the high rotation roller by 10 to 30 rotations per minute, and the roller temperature is set at 700 to 150° C., so as to give an average diameter size of the dispersed particles of the releasing agent in the resulting toner of 0.1 to 3 $\mu$m. Subsequently, the resulting powder and the external agent are stirred and mixed with a high-performance agitator such as Supermixer or a Henschel mixer, thereby depositing the external additive on the toner surfaces, to give the toner of the present invention.

It is preferable that the toner of the present invention prepared in the manner described above has a weight-average particle size of usually 3 to 10 $\mu$m.

In addition, in the toner of the present invention, there can be added in appropriate amounts auxiliary agents such as charge control agents, conductive adjustment agents, extenders, reinforcing fillers such as fibrous materials, antioxidants, anti-aging agents, and the like.

The toner of the present invention prepared in the manner described above has a glass transition point of from 56° to 75° C., preferably from 60° to 65° C., from the viewpoints of the storage ability, the prevention of filming, and the fixing ability.

In addition, the water content in the toner of the present invention is from 0.1 to 0.5% by weight, preferably from 0.15 to 0.3% by weight, in order to obtain excellent chargeability.

The color toner of the present invention may be used alone as a developer when it contains magnetite fine powders. When the toner does not contain magnetite fine powders, it may be used as a nonmagnetic one-component developer, or in an alternative, it may be mixed with a carrier to give a two-component developer. The color toner is preferably used as a nonmagnetic one-component developer from the aspects of having excellent triboelectric chargeability and offset properties.

Further, the present invention provides a process for nonmagnetic one-component development applying the color toner of the present invention to an apparatus for nonmagnetic one-component development. The development of the present invention includes, for instance, a method comprising loading the color toner of the present invention to a developing device comprising a nonmagnetic developer roller and a blade, the blade serving to regulate a toner layer formed on the nonmagnetic developer roller into a uniform thickness and to supply electric charges to the toner.

In addition, since the color toner of the present invention is extremely excellent in offset resistance, the color toner can be used in the fixing device without an oil-supplying device.

EXAMPLES

Glass Transition Points of Resin and Toner, and Melting Point and Endothermic Energy of Releasing Agent Measured by raising the temperature at a heating rate of 10° C./minute with a differential scanning calorimeter "DSC 210" (manufactured by Seiko Instruments, Inc.).

Water Content of Toner

The toner in an amount of 100 g is dried at 50° C. under reduced pressure conditions of about 1 kPa for 24 hours in a dryer, and the percentage of a weight change before and after drying is calculated.

Average Diameter Size of Dispersed Particles of Releasing Agent (1) The toner coated with an epoxy resin is thinly sliced to a thickness of about 100 nm in a frozen state, and the major axis and the minor axis of the releasing agent dispersed in the toner are measured with a transmission electron microscope.

(2) From the values of the major axis and the minor axis obtained, the domain size of the releasing agent is calculated. Here, the domain size is calculated by the following equation:

$$\text{Domain Size} = \frac{\text{Major Axis} + \text{Minor Axis}}{2}$$

(3) The procedures of (1) and (2) are repeated, and 50 domain sizes of the releasing agent dispersed in the toner are measured. The average diameter size of the dispersed particles is obtained by substituting the resulting domain size ($D_p$) into the following equation:

$$\text{Average Diameter Size of Dispersed Particles} = \frac{\sum(n_p D_p^2)}{\sum(n_p D_p)}$$

wherein $n_p$ is a number of the dispersed particles of which domain size is $D_p$.

wherein $n_p$ is a number of the dispersed particles of which domain size is $D_p$.

Kneading Conditions A

A continuous twin roller type kneader comprising a roller having an outer diameter of 0.12 m and an effective roller length of 0.8 m is used, and the rotational speed of a high rotation roller is set to 75 rotations per minute, the rotational speed of a low rotation roller is set to 50 rotations per minute, the gap between the rollers is set at 0.0001 m, a heating medium temperate at a raw material supplying side of the high rotation roller is set at 100° C., and a cooling medium temperature at a raw material supplying side of the low rotation roller is set at 80° C. In addition, the feeding rate of the mixture is 4 kg/hour, and the average residence time is about 10 minutes.

Kneading Conditions B

The same conditions as Kneading Conditions A except that the heating medium temperature at a raw material supplying side of the high rotation roller is set at 130° C.

Kneading Conditions C

Kneading is carried out with a uni-directional rotatable twin-screw extruder having an entire length of the kneading portion of 1,560 mm, a screw diameter of 42 mm, a barrel inner diameter of 43 mm. The roller rotation speed is set at 200 rotations per minute, the heating temperature inside the roller is set at 100° C., the feeding rate of the mixture is 40 kg/hour, and the average residence time is about 21 seconds.

Resin Preparation Example 1

There were added together 1 mol of polyoxyethylene (2.2)-2,2-bis(4-hydroxyphenyl)propane, 3 mol of polyoxypropylene(2.2)- 2,2-bis(4-hydroxyphenyl)propane, 3.6 mol of terephthalic acid, 0.3 mol of trimellitic acid and 4 g of dibutyltin oxide. The ingredients were reacted with stirring at 230° C. under nitrogen atmosphere until a point where the softening point as determined by a method in accordance with ASTM E28-67 reached 110° C., to give Resin A. The glass transition point of Resin A was 60° C.

Resin Preparation Example 2

There were added together 1 mol of polyoxyethylene (2.2)-2,2-bis(4-hydroxyphenyl)propane, 3 mol of polyoxypropylene(2.2)-2,2-bis(4-hydroxyphenyl)propane, 1.8 mol of terephthalic acid, 2.7 mol of trimellitic acid and 4 g of dibutyltin oxide. The ingredients were reacted with stirring at 230° C. under nitrogen atmosphere until a point where the softening point as determined by a method in accordance with ASTM E28-67 reached 138° C., to give Resin B. The glass transition point of Resin B was 66° C.

Resin Preparation Example 3

There were added together 0.15 mol of polyoxyethylene (2.2)-2,2-bis(4-hydroxyphenyl)propane, 2.85 mol of polyoxypropylene(2.2)-2,2-bis(4-hydroxyphenyl)propane, 1.1 mol of terephthalic acid, 1.6 mol of adipic acid and 4 g of dibutyltin oxide. The ingredients were reacted with stirring at 230° C. under nitrogen atmosphere until a point where the softening point as determined by a method in accordance with ASTM E28-67 reached 99° C., to give Resin C. The glass transition point of Resin C was 56° C.

Examples 1 to 16

In a Henschel mixer were sufficiently mixed 100 parts by weight of Resin A as a resin binder, a coloring agent in an amount and kind specified in Table 1, 5 parts by weight of "Carnauba Wax C1" (manufactured by Kato Yoko K.K., melting point: 81° C.) as a releasing agent, and 1 part by weight of "LR-147" (manufactured by Japan Carlit) as a charge control agent. Thereafter, the mixture was melt-kneaded under Kneading Conditions A, cooled, and roughly pulverized. Subsequently, the roughly pulverized product was finely pulverized with a jet mill, and classified to give a powder having a weight-average particle size of 7.5 $\mu$m. To 100 parts by weight of the resulting powder was added 2.0 parts by weight of "AEROSIL R-972" (manufactured by Nihon Aerosil K.K.) as an external additive, and mixed with a Henschel mixer, whereby subjecting the powder to a surface treatment, to give each of Toners Y1 to Y9, Toners M1 to M3, and Toners C1 to C4.

TABLE 1

| | Coloring Agent | Amount (Parts by Weight) |
|---|---|---|
| Example 1 [Toner Y1] | P.Y. 17 | 3 |
| Example 2 [Toner Y2] | P.Y. 93 | 3 |
| Example 3 [Toner Y3] | P.Y. 128 | 3 |
| Example 4 [Toner Y4] | P.Y. 151 | 3 |
| Example 5 [Toner Y5] | P.Y. 155 | 3 |
| Example 6 [Toner Y6] | P.Y. 173 | 3 |
| Example 7 [Toner Y7] | P.Y. 180 | 3 |
| Example 8 [Toner Y8] | P.Y. 185 | 3 |
| Example 9 [Toner Y9] | S.Y. 162 | 3 |
| Example 10 [Toner M1] | P.R. 57:1 | 4 |
| Example 11 [Toner M2] | P.R. 122 | 6 |
| Example 12 [Toner M3] | P.R. 184 | 3 |
| Example 13 [Toner C1] | P.B. 15:3 | 3 |
| Example 14 [Toner C2] | P.B. 15:4 | 3 |
| Example 15 [Toner C3] | P.B. 15 | 3 |
| Example 16 [Toner C4] | P.B. 15:3 | 3 |
| | P.G. 7 | 0.5 |

Examples 17 and 18

The same procedures as in Example 16 were carried out except for using as a charge control agent 1 part by weight of "BONTRON E-81" (manufactured by Orient Chemical Co., Ltd.) or 1 part by weight of "BONTRON E-84" (manufactured by Orient Chemical Co., Ltd.), respectively, in place of "LR-147", to give Toner C5 and Toner C6.

Example 19

The same procedures as in Example 16 were carried out except for changing the amount of "Carnauba Wax C1" to 10 parts by weight, to give Toner C7.

Example 20 and Comparative Example 1

The same procedures as in Example 19 were carried out except for melt-kneading under Kneading Conditions B or C, respectively, in place of Kneading Conditions A, to give Toner C8 and Toner C9.

Examples 21 and 22

The same procedures as in Example 16 were carried out except for using as a releasing agent 5 parts by weight of "SP-105" (manufactured by Sazole, polyethylene wax, melting point: 90° C.) or 5 parts by weight of "NP-056" (manufactured by Mitsui Chemical Co., Ltd., polypropylene wax, melting point: 92° C.), respectively, in place of "Carnauba Wax C1", to give Toner C10 and Toner C11.

Examples 23 and 24

The same procedures as in Example 16 were carried out except for using as an external additive 2.0 parts by weight of "HDK H2000" (manufactured by Wacker Chemicals) or 1.0 part by weight of "CAB-O-SIL TS-530" (manufactured by CABOT), respectively, in place of "Aerosil R-972", to give Toner C12 and Toner C13.

Comparative Example 2

The same procedures as in Example 16 were carried out except for changing the amount of "Aerosil R-972" to 0.8 parts by weight, to give Toner C14.

Comparative Example 3

The same procedures as in Example 16 were carried out except for using as an external additive a mixture of 3.0 parts by weight of "Aerosil R-972" and 2.5 parts by weight of "STT-30A" (manufactured by Titanium Kogyo, raw material: titanium dioxide, average particle size: about 40 nm) in place of 2.0 parts by weight of "Aerosil R-972", to give Toner C15.

Comparative Examples 4 and 5

The same procedures as in Example 16 were carried out except for using 100 parts by weight of Resin B or Resin C, respectively, in place of Resin A, to give Toner C16 and Toner C17.

All of the water contents of each of the toners obtained by the above Examples and Comparative Examples were 0.2% by weight, respectively. In addition, aside from the fact that the glass transition points of Toner C16 (Comparative Example 4) and Toner C17 (Comparative Example 5) were 66° C. and 54° C., respectively, all of the remaining toners had a glass transition point of 58° C. Further, the average diameter size of the dispersed particles of the releasing agent in the toner and the endothermic energy are shown in Table 2.

TABLE 2

| | Releasing Agent | | | |
|---|---|---|---|---|
| | Average Diameter of Dispersed Particles ($\mu$m) | Endothermic Energy (mj/l mg Toner) | Offset Resistance | Storage Ability |
| Example 1 [Toner Y1] | 0.7 | 10.6 | ⊚ | ○ |
| Example 2 [Toner Y2] | 0.7 | 10.3 | ⊚ | ○ |
| Example 3 [Toner Y3] | 0.8 | 9.8 | ⊚ | ○ |
| Example 4 [Toner Y4] | 0.8 | 10.1 | ⊚ | ○ |
| Example 5 [Toner Y5] | 0.6 | 9.9 | ⊚ | ○ |
| Example 6 [Toner Y6] | 0.7 | 10.2 | ⊚ | ○ |
| Example 7 [Toner Y7] | 0.8 | 10.5 | ⊚ | ○ |
| Example 8 [Toner Y8] | 0.7 | 10.4 | ⊚ | ○ |
| Example 9 [Toner Y9] | 0.6 | 10.7 | ⊚ | ○ |
| Example 10 [Toner M1] | 0.7 | 9.8 | ⊚ | ○ |
| Example 11 [Toner M2] | 0.7 | 10.1 | ⊚ | ○ |
| Example 12 [Toner M3] | 0.8 | 9.6 | ⊚ | ○ |
| Example 13 [Toner C1] | 0.7 | 9.4 | ⊚ | ○ |
| Example 14 [Toner C2] | 0.7 | 10.0 | ⊚ | ○ |
| Example 15 [Toner C3] | 0.7 | 9.7 | ⊚ | ○ |
| Example 16 [Toner C4] | 0.7 | 10.5 | ⊚ | ○ |
| Example 17 [Toner C5] | 0.7 | 9.8 | ⊚ | ○ |
| Example 18 [Toner C6] | 0.7 | 9.7 | ⊚ | ○ |

TABLE 2-continued

| | Releasing Agent | | | |
|---|---|---|---|---|
| | Average Diameter of Dispersed Particles (μm) | Endothermic Energy (mj/l mg Toner) | Offset Resistance | Storage Ability |
| Example 19 [Toner C7] | 1.2 | 19.4 | ◎ | ○ |
| Example 20 [Toner C8] | 2.9 | 18.7 | ◎ | ○ |
| Comp. Example 1 [Toner C9] | 5.4 | 17.4 | ◎ | ○ |
| Example 21 [Toner C10] | 1.1 | 11.2 | ○ | ○ |
| Example 22 [Toner C11] | 1.0 | 4.1 | Δ | ○ |
| Example 23 [Toner C12] | 0.7 | 9.8 | ◎ | ○ |
| Example 24 [Toner C13] | 0.7 | 9.8 | ◎ | ○ |
| Comp. Example 2 [Toner C14] | 0.7 | 9.8 | ◎ | x |
| Comp. Example 3 [Toner C15] | 0.7 | 9.8 | ○ | ◎ |
| Comp. Example 4 [Toner C16] | 0.7 | 9.7 | ◎ | ○ |
| Comp. Example 5 [Toner C17] | 0.7 | 10.1 | ◎ | x |

Test Example 1 [Evaluation of Offset Resistance]

In a ball-mill were mixed 5 parts by weight of a toner and 95 parts by weight of a ferrite carrier coated with a silicone resin and having a particle size of 50 μm, to prepare each of yellow, magenta, and cyan developers. Each of the resulting developers was loaded on "Preter 550" (manufactured by Ricoh), and the offset resistance was evaluated from a fixable temperature region in accordance with the following evaluation criteria. The results are shown in Table 2.

Evaluation Criteria

◎: Fixable temperature region being 50° C. or higher, particularly favorable in practical use.

○: Fixable temperature region being 30° C. or higher and lower than 50° C., posing no problem in practical use.

Δ: Fixable temperature region being 10° C. or higher and lower than 30° C., posing no problem in practical use.

×: Fixable temperature region being lower than 10° C., posing problems in practical use.

Test Example 2 [Evaluations of Storage Ability and Durability]

Yellow toner, magenta toner and cyan toner in the same amounts in a combination shown in Table 3 were loaded to a nonmagnetic one-component developer device equipped with a heat roller "PAGEPRESTO N-4" (manufactured by CASIO COMPUTER CO., LTD.) and "TEKTRONIX PHASER 560" (manufactured by SONY TEKTRONIX). Printing was carried out continuously for 10,000 sheets with a printing ratio of 4% for each color. The agglomeration state of each of the remaining toners and the image quality of the 10,000th sheet were visually examined to evaluate the storage ability and the durability within the developer device in accordance with each of the following evaluation criteria. The results are shown in Tables 2 and 3.

Evaluation Criteria for Storage Ability

◎: No agglomeration is found at all.

○: Substantially no agglomeration is found.

×: Agglomeration is found.

Evaluation Criteria for Durability

◎: Fixed image is particularly clear.

○: Fixed image is clear.

Δ: Fixed image is slightly unclear.

×: Fixed image is poor. Where indicated as (F), which stands for 'filming,' means that the toner deposition onto the photoconductor is generated.

Test Example 3 [Evaluation of Color Reproducibility]

Yellow toner, magenta toner and cyan toner in the same amounts in a combination shown in Table 3 were loaded to a nonmagnetic one-component developer device equipped with a heat roller "PAGEPRESTO N-4" (manufactured by CASIO COMPUTER CO., LTD.) and "TEKTRONIX PHASER 560" (manufactured by SONY TEKTRONIX). The developing bias was adjusted so as to have an amount of each of yellow, magenta, and cyan colors deposited of 0.6 mg/cm$^2$ each, and the yellow solid images, the magenta solid images, the cyan solid images, the process-red solid images, the process-green solid images, and the process-blue solid images were obtained. Each of a* and b* of the fixed images was measured with "X-Rite 938" (manufactured by X-Rite), and the degrees of coloration for a* and b* were plotted. The resulting hexagonal area was measured, whereby evaluating the color reproducibility in accordance with the following evaluation criteria. The results are shown in Table 3.

Evaluation Criteria

◎: The hexagonal area exceeds 6,000, thereby being particularly favorable in practical use.

○: The area is from 3,500 to 6,000, thereby posing no problem in practical use.

×: The area is less than 3,500, thereby posing some problems in practical use. Where indicated as (C) means that there are defects in the values of a* and b* of the cyan toner, making the area undesirably small.

Printing of each of the images was carried out up until 6,000 sheets, and similar results were obtained.

TABLE 3

| Combination of Toners | | | Dura- | Color Reproduc- |
|---|---|---|---|---|
| Yellow | Magenta | Cyan | bility | ibility |
| Toner Y1 | Toner M1 | Toner C1 | ◎ | ◎ |
| Toner Y2 | Toner M1 | Toner C1 | ◎ | ○ |
| Toner Y3 | Toner M1 | Toner C1 | ◎ | ◎ |
| Toner Y4 | Toner M1 | Toner C1 | ◎ | ◎ |
| Toner Y5 | Toner M1 | Toner C1 | ◎ | ◎ |
| Toner Y6 | Toner M1 | Toner C1 | ◎ | ○ |
| Toner Y7 | Toner M1 | Toner C1 | ◎ | ○ |
| Toner Y8 | Toner M1 | Toner C1 | ◎ | ○ |
| Toner Y9 | Toner M1 | Toner C1 | ◎ | ○ |
| Toner Y1 | Toner M2 | Toner C1 | ◎ | ◎ |
| Toner Y1 | Toner M3 | Toner C1 | ◎ | ◎ |
| Toner Y1 | Toner M1 | Toner C2 | ◎ | ○ |
| Toner Y1 | Toner M1 | Toner C3 | ◎ | ○ |
| Toner Y1 | Toner M1 | Toner C4 | ◎ | ○ |
| Toner Y1 | Toner M1 | Toner C5 | ◎ | ○ |
| Toner Y1 | Toner M1 | Toner C6 | ◎ | ○ |
| Toner Y1 | Toner M1 | Toner C7 | ◎ | ◎ |
| Toner Y1 | Toner M1 | Toner C8 | ○ | ◎ |
| Toner Y1 | Toner M1 | Toner C9 | Δ | ◎ |
| Toner Y1 | Toner M1 | Toner C10 | ◎ | ◎ |
| Toner Y1 | Toner M1 | Toner C11 | ◎ | ○ |
| Toner Y1 | Toner M1 | Toner C12 | ◎ | ◎ |
| Toner Y1 | Toner M1 | Toner C13 | ◎ | ◎ |
| Toner Y1 | Toner M1 | Toner C14 | x (F) | ○ |
| Toner Y1 | Toner M1 | Toner C15 | x (F) | ○ |
| Toner Y1 | Toner M1 | Toner C16 | ◎ | x (C) |
| Toner Y1 | Toner M1 | Toner C17 | x (F) | ◎ |

It is clear from the above results that the toners of the comparative examples are poor in any one of the offset resistance, the storage ability, the durability and the color reproducibility, whereas the toners of the examples are excellent in all these properties.

According to the present invention, there can be provided a color toner being free from the generation of filming onto a photoconductor and less likely to cause offset even during heat roll fixing, and having excellent storage ability, durability and color reproducibility.

What is claimed is:

1. A color toner comprising:

(A) a resin binder comprising a polyester, as a main component, obtained by polycondensing a polyhydric alcohol component and a carboxylic acid component, wherein the polyhydric alcohol component comprises a compound represented by the formula (I):

(I)

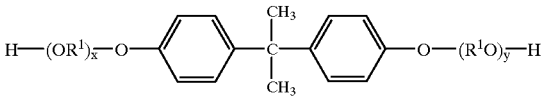

wherein $R^1$ is an alkylene group having 2 to 4 carbon atoms; x and y are positive numbers, wherein a sum of x and y is from 1 to 16, in an amount of 5% by mol or more of an entire polyhydric alcohol component, and wherein the carboxylic acid component comprises 50% by mol or more of a dicarboxylic acid compound and 50% by mol or less of a tricarboxylic or higher polycarboxylic acid compound;

(B) a releasing agent having an average diameter size of dispersed particles in the color toner of from 0.1 to 3 $\mu$m;

(C) a coloring agent; and (D) an external additive having a particle size of from 4 to 200 nm, wherein the content of the external additive is 1 to 5 parts by weight, based on 100 parts by weight of the toner before treatment with the external additive, wherein the color toner has a glass transition point of from 56° to 75° C., and a water content of from 0.1 to 0.5% by weight.

2. The color toner according to claim 1, wherein the melting point of the releasing agent is from 65° to 110° C.

3. The color toner according to claim 1, wherein the releasing agent has endothermic energy of from 5 to 25 mj per 1 mg of the toner.

4. The color toner according to claim 1, wherein the releasing agent is at least one selected from the group consisting of natural waxes, synthetic waxes and coal waxes.

5. The color toner according to claim 1, wherein a content of the polyester in the resin binder is from 50 to 100% by weight.

6. The color toner according to claim 1, wherein the toner is used for full color development, and wherein the coloring agent is one or more yellow pigments selected from the group consisting of C.I. Pigment Yellow 17, C.I. Pigment Yellow 93, C.I. Pigment Yellow 128, C.I. Pigment Yellow 151, C.I. Pigment Yellow 155, C.I. Pigment Yellow 173, C.I. Pigment Yellow 180, C.I. Pigment Yellow 185, and Solvent Yellow 162; one or more magenta pigments selected from the group consisting of C.I. Pigment Red 57:1, C.I. Pigment Red 122, and C.I. Pigment Red 184; or one or more cyan pigments selected from the group consisting of C.I. Pigment Blue 15:3, C.I. Pigment Blue 15, C.I. Pigment Blue 15:4, and C.I. Pigment Green 7.

7. A process for nonmagnetic one-component development, comprising applying the color toner according to claims 1 to an apparatus for nonmagnetic one-component development.

8. A process for nonmagnetic one-component development, comprising applying the color toner according to claim 2 to an apparatus for nonmagnetic one-component development.

9. A process for nonmagnetic one-component development, comprising applying the color toner according to claim 3 to an apparatus for nonmagnetic one-component development.

10. A process for nonmagnetic one-component development, comprising applying the color toner according to claim 4 to an apparatus for nonmagnetic one-component development.

11. A process for nonmagnetic one-component development, comprising applying the color toner according to claim 5 to an apparatus for nonmagnetic one-component development.

12. A process for nonmagnetic one-component development, comprising applying the color toner according to claim 6 to an apparatus for nonmagnetic one-component development.

* * * * *